US007703470B2

(12) United States Patent
Wu

(10) Patent No.: US 7,703,470 B2
(45) Date of Patent: Apr. 27, 2010

(54) SAFETY SWITCH OF GAS STOVE

(76) Inventor: Sen-Yu Wu, No. 27, Alley 81, Lane 88, Wu-Chuan Road, Feng-Chou Village, Shen-Kang Country, Taichung Hsien (TW)

( * ) Notice: Subject to any disclaimer, the term of this patent is extended or adjusted under 35 U.S.C. 154(b) by 588 days.

(21) Appl. No.: 11/730,351

(22) Filed: Mar. 30, 2007

(65) Prior Publication Data

US 2008/0216897 A1 Sep. 11, 2008

(51) Int. Cl.
*F23D 5/16* (2006.01)

(52) U.S. Cl. ..... 137/66; 431/28

(58) Field of Classification Search ..... 137/65, 137/66; 431/28, 66

See application file for complete search history.

(56) References Cited

U.S. PATENT DOCUMENTS 4,543,974 A * 10/1985 Dietiker et al. ..... 137/66
6,322,352 B1 * 11/2001 Zink ..... 431/27
6,968,853 B2 * 11/2005 Amazorrain ..... 137/66
7,044,729 B2 * 5/2006 Ayastuy et al. ..... 431/25

* cited by examiner

*Primary Examiner*—Kevin L Lee

(57) ABSTRACT

A safety switch of a gas stove includes a main member including a cone valve chamber, a first chamber, a second chamber, an input tunnel, a first output tunnel and a second output tunnel connected to the second chamber and outside. A close member, an electromagnetic valve and a first temperature controller are mounted in the valve chamber, the first chamber and the second chamber respectively. A second temperature controller and a knob set are mounted on the main member. The knob set is connected to the close member, the first temperature controller and the electromagnetic valve to turn the close member and activate the first temperature controller and the electromagnetic valve for control of gas flowing into the input tunnel or flowing out of the first and second output tunnels. The present invention provides the functions of sequent ignition, shut the gas when flame is out, and temperature control.

15 Claims, 5 Drawing Sheets

SAFETY SWITCH OF GAS STOVE

BACKGROUND OF THE INVENTION

1. Field of the Invention

The present invention relates generally to a gas stove, and more particularly to a safety switch of a gas stove.

2. Description of the Related Art

Conventional gas stoves are equipped with a multi-position ignition switch, which includes a main member with a chamber therein, an input tunnel and a plurality of output tunnels communicated with the chamber, a close member provided in the chamber of the main member, an electromagnetic valve provided in the chamber and connected to the close member, a knob provided on the main member and connected to the close member, and a thermocouple electrically connected to the electromagnetic valve. The knob is pressed and turned to drive a shaft of the close member forward the electromagnetic valve and move a plug of the electromagnetic valve away, therefore, gas may flow into the close member and flow through the output tunnel for the mother flame ignition device. And then, the thermocouple may sense the heat of the mother flame and generate current to activate the electromagnetic valve for return of the plug that gas keeps providing to the burner for maim flame to complete the ignition procedure.

When the flame of the burner is out, the thermocouple can't sense the heat anymore that the electromagnetic valve returns to the initial condition to shut the gas up. In addition, there are ignition devices with thermal control function presented in the market.

In other words, the conventional ignition devices usually have functions of sequent ignition, shut the gas when flame is out, and temperature control. However, there was no ignition device having all of the three functions. Some ignition device provides a control unit to integrate these functions together that produces many new drawbacks, such as complex hose structure, huge size and inconvenient in operation. Furthermore, some conventional ignition devices having one or two functions still have safety problems.

SUMMARY OF THE INVENTION

The primary objective of the present invention is to provide a safety switch, which has all of the function of sequent ignition, shut the gas when flame is out, and temperature control.

According to the objective of the present invention, a safety switch of a gas stove includes a main member including a cone valve chamber, a first chamber, a second chamber, a first check port between the valve chamber and the first chamber, a second check port between the valve chamber and the second chamber, an input tunnel connected to the first chamber, a first output tunnel and a second output tunnel connected to the second chamber and outside of the main member respectively. A close member, which includes at least a gas bores, is received in the valve chamber and complementary to the valve chamber. An electromagnetic valve is received in the first chamber to seal the first check port normally. A first temperature controller is received in the second chamber and associated with the second check port to seal the second check port normally. A second temperature controller is received in the second output tunnel with an end sensing a temperature of the gas stove to switch the second tunnel communicated with outside or not and change a gas flow rate; and a knob set is mounted at the main member and connected to the close member, the first temperature controller and the electromagnetic valve to turn the close member and activate the first temperature controller and the electromagnetic valve.

DETAILED DESCRIPTION OF THE INVENTION

Figure 1:
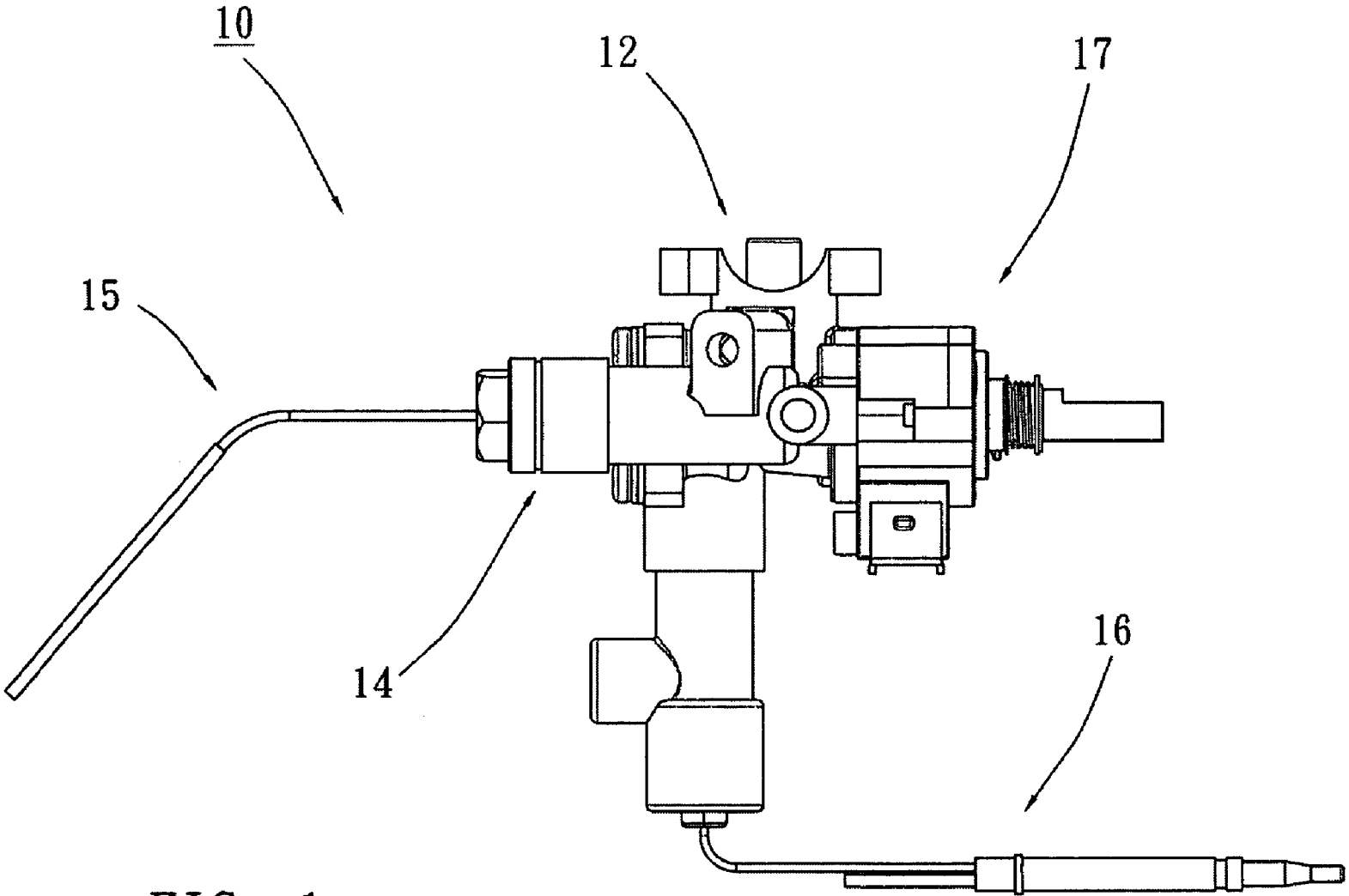
FIG. 1 is a front view of a preferred embodiment of the present invention.
Figure 2:
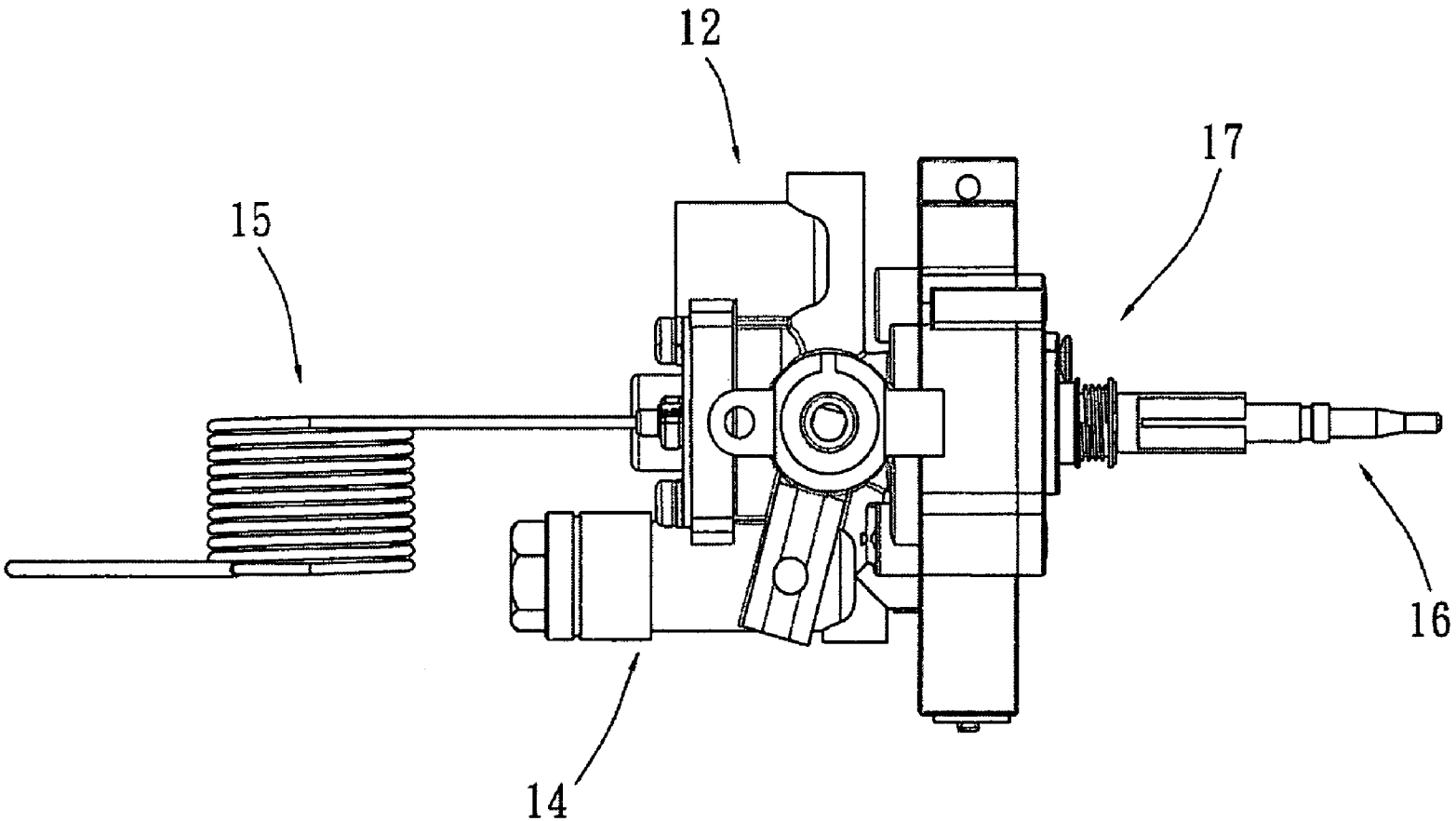
FIG. 2 is a top view of the preferred embodiment of the present invention.
Figure 3:
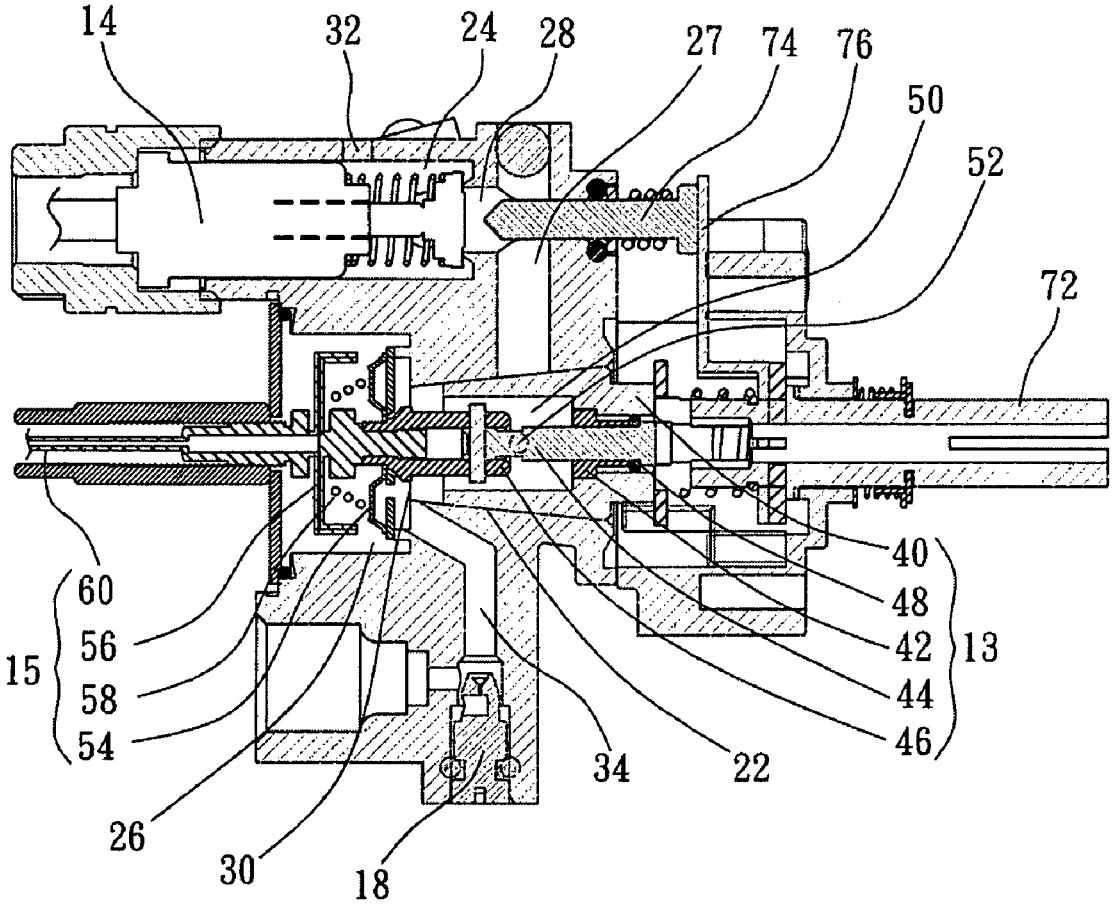
FIG. 3 is a sectional view of the preferred embodiment of the present invention.
Figure 4:
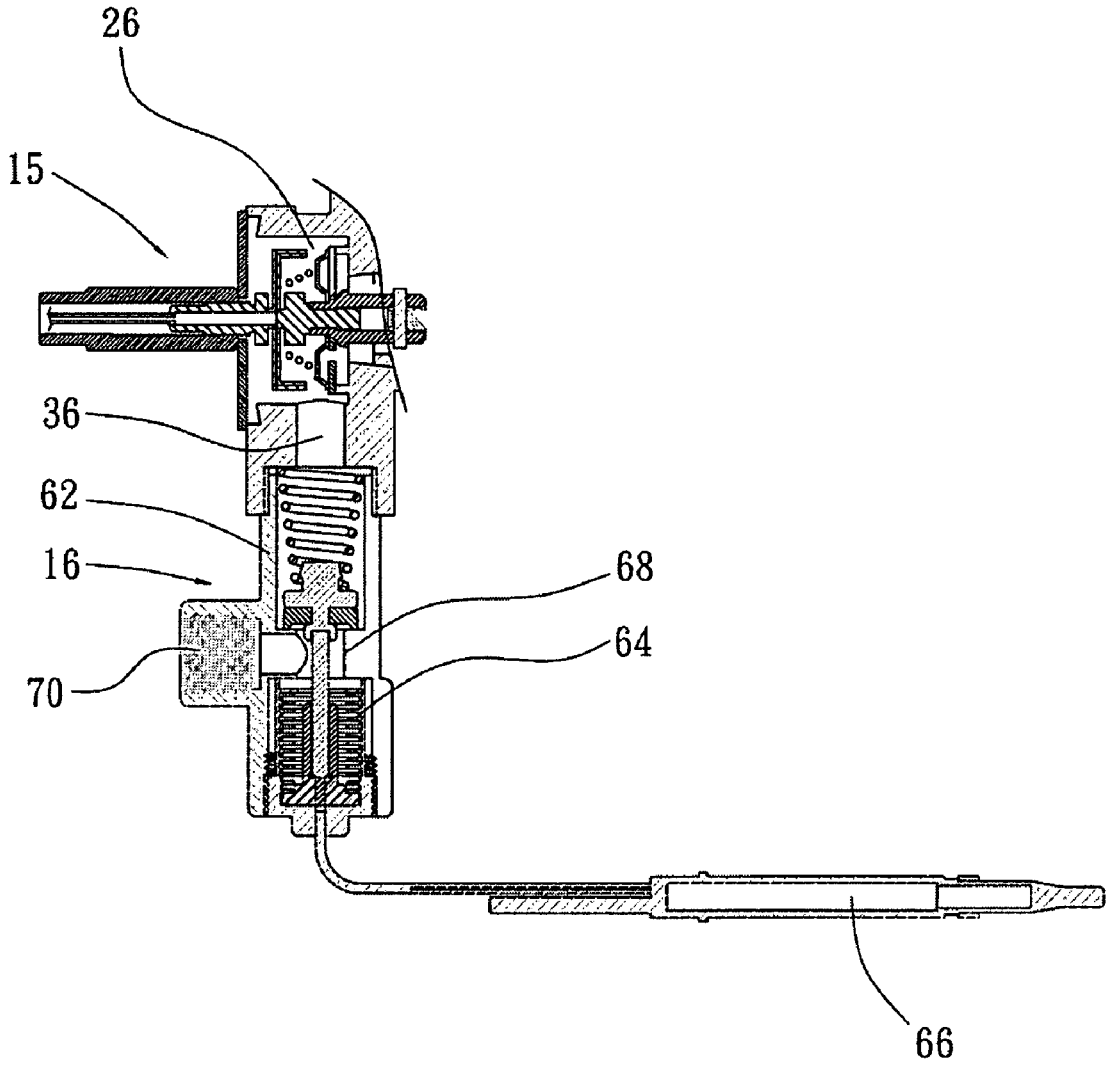
FIG. 4 is a sectional view of in parts of the preferred embodiment of the present invention.

As shown in FIG. 1 to FIG. 4, a safety switch 10 of the preferred embodiment of the present invention, which may be mounted on any type of gas stoves, such as roast stove, oven, or other relative stoves, includes a a main member 12, a close member 13, an electromagnetic valve 14, a first temperature controller 15, a second temperature controller 16 and a knob set 17.

The main member 12 includes a cone valve chamber 22, a first chamber 24 and a second chamber 26 therein. The valve chamber 22 has an end communicated with the first chamber 24 through a gas tunnel 27 and another end communicated with the second chamber 26 directly. A first check port 28 is provided at a junction between the gas tunnel 27 and the first chamber 24, and a second check port 30 is provided at a junction between the valve chamber 22 and the second chamber 26. An input tunnel 32 has an end communicated with the first chamber 24. A first output tunnel 34 and a second output tunnel 36 are communicated with the second chamber 26 and a mother flame ignition device (not shown) respectively.

The close member 12 includes a close device 40, a fixed device 42, a close shaft 44, a rotary device 46 and a leakage-proof device 48. The close device 40 is received in the valve chamber 22 with a cone-like shape complementary to the valve chamber 22. The close device 40 has a center bore 50 at a center thereof and a gas bore 52 at a lateral side communicated with the center bore 50. The fixed device 42 is a barrel fixed on the close device 40 on an end of the center bore 50. The close shaft 44 has an end inserted into the center bore 50 through the fixed device 42, and the rotary device 46 is fixed on the end of the close shaft 44. The leakage-proof device 48 is an O-ring fitted to the close shaft 44.

The electromagnetic valve 14, which is a conventional electromagnetic valve used in a conventional gas stove switch, is received in the first chamber 24 and connected to a thermocouple of the gas stove switch to control the first check port 28 opening or closing.

The first temperature controller 15, which is a conventional fluid-type temperature controller, includes a sealing plate 54, a film cover 56, an elastic device 58 between the sealing plate 54 and the film cover 56 and a thermal sensor 60. The sealing plate 54 is connected to the rotary device 46 to be urged by the elastic device 58 for closing the second check port 30. The film cover 56 is a hollow member. The thermal sensor 60 is mounted in the gas stove, such as on a pot put on the gas stove or an oven, and fixed to the sealing plate 54 through the film cover 56. The film cover 56 and the thermal sensor 60 are filled with a fluid (liquid or gas) with a high thermal expansion coefficient. The film cover 56 will be expanded to move the elastic device 58 and the sealing plate 54 toward the second check port 30 when the thermal sensor 60 senses a temperature over a preset temperature.

The second temperature controller 16, which is a conventional fluid-type temperature controller too, includes a housing 62, a valve 64 and a thermal sensor 66. The housing 62, which is a tubular member, is fixed to an output end of the second output tunnel 36. The housing 62 has a third check port 68 therein and an outlet 70 at a lateral side. The valve 64 is received in the housing 62 to seal the third check port 68. The thermal sensor 66 is mounted beside a burner of the gas stove and connected to the valve 64. The thermal sensor 66 and the valve 64 are filled with a fluid (liquid or gas) with a high thermal expansion coefficient. The valve 64 is activated by the thermal sensor 66 to open the third check port 68 when the thermal sensor 60 senses a temperature of the burner over a preset temperature.

The knob set 17, which is a conventional device used in a conventional gas stove, includes a shaft 72, a pushing device 74 and a driving device 76. The shaft 72 is connected to the close device 40. The pushing device 74 passes through the main member 12 and the first check port 28 and is associated with the electromagnetic valve 14. The driving device 76 is connected to the shaft 72 and the pushing device 74.

The present invention further provides a control device 18 screwed into the first output tunnel 34 of the main member to control the gas flow rate of the first output tunnel 34. The control device 18 is designated to switch the safety switch of the present invention for a natural gas stove or for liquefied gas stove.

Figure 5:
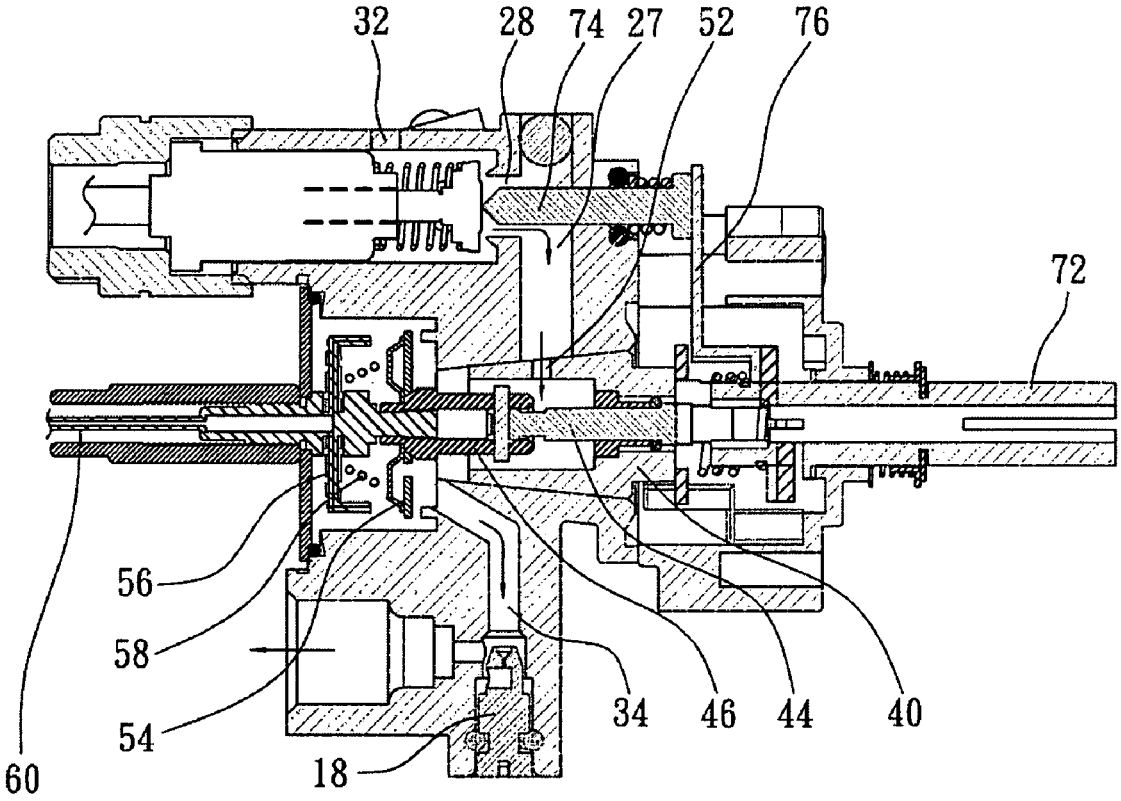
FIG. 5 is a sketch diagram of the preferred embodiment of the present invention in operation.

As shown in FIG. 5, when the shaft 72 of the knob set 17 is pressed and turned, the driving device 76 is moved by the shaft 72 to press the pushing device 74 for activation of the electromagnetic valve 14. The sealing plate 54 is moved by the thermal sensor 60 and will not seal the second check port 30 (the rotary device 46 and the thermal device 60 are screwed together so that the rotary device 46 will move the thermal sensor 60 outwards when the rotary device 46 is turned). At the same time, the close device 40 is turned to communicate the gas bore 52 to gas tunnel 27, therefore gas flows into the close device 40 through the first check port 28 and the gas tunnel 27, and then flows to the first and second output tunnels 34 and 36 through the second check port 30 for ignition sequence:

The gas in the first output tunnel 34 flows to the mother flame ignition device to light the mother flame. The mother flame heats the thermocouple and the thermal sensor 66 of the gas switch to activate the thermocouple for activation of the electromagnetic valve 14 and keeping the first check port 28 opening.

The gas in the second output tunnel 36 flows to the second temperature controller 16. When the thermal sensor 66 senses the mother flame over the preset temperature (the gas therein will expand to activate the valve 64), the valve 64 will not seal the third check port 68 to let gas flowing to the burner for lighting the main flame. As the temperature raising, the valve 64 is moved away from the third check port 68 to increase the gas flow rate for the flame so that the gas stove will not have a flame explosion.

In addition, when the main flame is out, the thermocouple will return the electromagnetic valve 14 so that the first check port 28 is sealed to prevent the gas from leakage.

The safety switch 10 of the present invention further has the function of keeping temperature an adjusting temperature:

When the thermal sensor 60 senses a temperature over the preset temperature, the fluid will expand (so as the film cover 56) to move the elastic device 58 and the sealing plate 54 toward the second check port 30 to decrease the gas flow rate such that the temperature is lowered to keeping the temperature.

When turning the shaft 72 to turn the close device 40 and the close shaft 44, the close shaft 44 turns the rotary device 46 to move the thermal sensor 60 outwards, therefore the sealing plate 54, the film cover 56 and the elastic device 58 are moved together to increase the gas flow rate through the second check port 30 for raising the temperature.

In conclusion, the safety switch of the present invention has the functions of sequent ignition, safety protection when flame is out and temperature control. The structure of the present invention is not complex and easy to operate that provides a safer way of using the gas stove.

The description above is a few preferred embodiments of the present invention and the equivalence of the present invention is still in the scope of the claim of the present invention.

What is claimed is:

1. A safety switch of a gas stove, comprising:

a main member including a cone valve chamber, a first chamber, a second chamber, a first check port between the valve chamber and the first chamber, a second check port between the valve chamber and the second chamber, an input tunnel connected to the first chamber, a first output tunnel and a second output tunnel connected to the second chamber and outside of the main member respectively;

a close member, which includes at least a gas bore, received in the valve chamber and complementary to the valve chamber;

an electromagnetic valve received in the first chamber to seal the first check port normally;

a first temperature controller received in the second chamber and associated with the second check port to seal the second check port normally;

a second temperature controller received in the second output tunnel with an end sensing a temperature of the gas stove to switch the second tunnel communicated with outside or not and change a gas flow rate; and a knob set mounted at the main member and connected to the close member, the first temperature controller and the electromagnetic valve to turn the close member and activate the first temperature controller and the electromagnetic valve.

2. The safety switch as defined in claim 1, wherein the main member further includes a gas tunnel communicated with the valve chamber and the first chamber, and the first check port is located between the gas tunnel and the first chamber.

3. The safety switch as defined in claim 2, wherein the gas tunnel is connected to a lateral side of the valve chamber and associated with the close member.

4. The safety switch as defined in claim 1, further comprising a control device movably mounted in the main member and associated with the first output tunnel to adjust a gas flow rate of the first output tunnel.

5. The safety switch as defined in claim 1, wherein the close member includes a close device with a center bore and the gas bore communicated with the center bore, a close shaft through the center bore of the close device, a rotary device connected to an end of the close shaft and a control valve.

6. The safety switch as defined in claim 5, wherein the close member further includes a fixed device mounted in the center bore of the close device to fix the close shaft in the center bore.

7. The safety switch as defined in claim 6, wherein the fixed device is a barrel.

8. The safety switch as defined in claim 6, wherein the close member further includes a leakage-proof device mounted on the fixed device and associated with the knob set.

9. The safety switch as defined in claim 8, wherein the leakage-proof device is an O-ring.

10. The safety switch as defined in claim 1, wherein the first temperature controller includes a sealing plate associated with the second check port and connected to the close member, a film cover and an elastic device between the sealing plate and the film cover.

11. The safety switch as defined in claim 10, wherein the first temperature controller further includes a thermal sensor, which is filled with a fluid with a high thermal expansion coefficient, mounted on the gas stove and connected to the film cover, which is a hollow member filled with a fluid with a high thermal expansion coefficient.

12. The safety switch as defined in claim 10, wherein the second temperature controller includes a housing, which has an outlet, connected to an output end of the second output tunnel, a valve mounted in the housing and associated with the outlet of the housing, and a thermal sensor mounted beside a burner of the gas stove and connected to the valve, wherein the thermal sensor and the valve are filled with a fluid with a high thermal expansion coefficient.

13. The safety switch as defined in claim 12, wherein the housing further includes a third check port associated with the outlet, and the valve switches the second output tunnel to be communicated with the outlet.

14. The safety switch as defined in claim 1, wherein the knob set includes a shaft connected to the close member, a pushing device through the main member and connected to the electromagnetic valve, and a driving device connected to the shaft and the pushing device to move the pushing device when the shaft is turned.

15. The safety switch as defined in claim 14, wherein the pushing device is connected to the electromagnetic valve through the first check port.

* * * * *